United States Patent [19]

Garrison et al.

[11] 4,178,853

[45] * Dec. 18, 1979

[54] MILD DETONATING CORD CONFINEMENT

[75] Inventors: C. Gene Garrison, San Jose; William Southern, Gilroy, both of Calif.

[73] Assignee: Teledyne McCormick Selph, an operating division of Teledyne Industries, Inc., Hollister, Calif.

[ * ] Notice: The portion of the term of this patent subsequent to Apr. 11, 1995, has been disclaimed.

[21] Appl. No.: 895,410

[22] Filed: Apr. 11, 1978

Related U.S. Application Data

[63] Continuation of Ser. No. 681,085, Apr. 28, 1976, Pat. No. 4,083,305.

[51] Int. Cl.[2] ..... C06C 5/00

[52] U.S. Cl. ..... 102/27 R

[58] Field of Search ..... 102/27 R

[56] References Cited

U.S. PATENT DOCUMENTS

| | | | |
|---|---|---|---|
| 2,380,312 | 7/1945 | Johnson | 102/27 R |
| 3,129,663 | 4/1964 | Schnepfe, Jr. | 102/27 R |
| 3,241,489 | 3/1966 | Andrew et al. | 102/27 R |
| 3,260,201 | 7/1966 | Kelley et al. | 102/27 R |
| 3,296,968 | 1/1967 | Shulman et al. | 102/27 R |
| 3,572,246 | 3/1971 | Hare et al. | 102/27 R |
| 3,726,216 | 4/1973 | Calder, Jr. et al. | 102/27 R |
| 3,730,097 | 5/1973 | Helfgeni et al. | 102/27 K |
| 3,903,800 | 9/1975 | Kilmer | 102/27 R |
| 4,083,305 | 4/1978 | Garrison et al. | 102/27 R |

*Primary Examiner*—Verlin R. Pendegrass

*Attorney, Agent, or Firm*—David H. Semmes; Warren E. Olsen

[57] ABSTRACT

Mild detonating cord confinement, particularly of the type including a metal covered mild detonating fuse as an inner core. The invention is directed to reducing cord diameter and weight, while totally confining explosive effects. The reduction in weight and diameter is achieved by employing a plurality of different coverings for the mild detonating fuse inner core, notably an extruded plastic jacket, a plurality of plastic fiber overbraid coverings and a stainless steel overbraid encircling the plastic fiber as an overbraid. A foamed polyethylene may be employed as the extruded plastic jacket.

9 Claims, 9 Drawing Figures

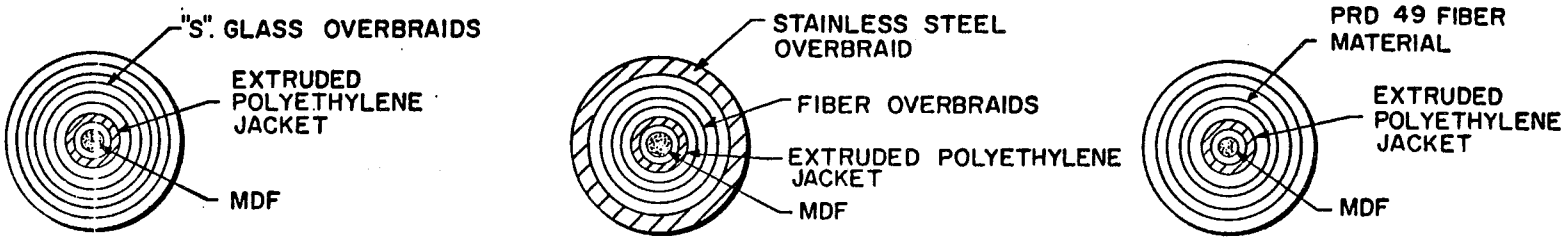
FIG. 1A
FIG. 1B
FIG. 1C
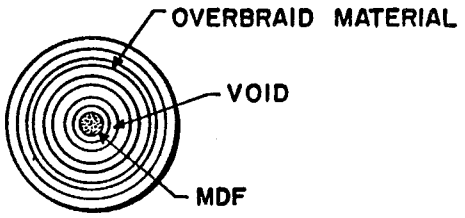
FIG. 1D
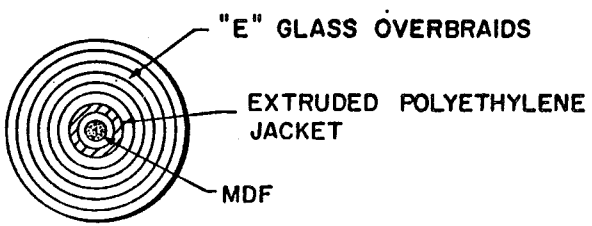
FIG. 1E

MILD DETONATING CORD CONFINEMENT

CROSS-REFERENCES TO RELATED APPLICATIONS

This is a continuation of application Ser. No. 681,085, filed Apr. 28, 1976 which is now U.S. Pat. No. 4,083,305.

BACKGROUND OF THE INVENTION (1) Field of the Invention

Reducing the diameter and weight of confined detonating fuse, while retaining or improving the confining characteristics. Current technology uses "E" glass for confinement manufactured by Owens Corning and conforming to U.S. Military Specification M/L-Y-1140. To achieve confinement, as many as twelve overbraid layers of "E" glass are used in conjunction with a plastic extrusion covering for abrasion resistance and environmental protection.

(2) Description of the Prior Art

| | |
|---|---|
| Great Britain | 847,743 |
| West Germany | 1,248,526 |
| West Germany | 1,124,413 |
| West Germany | 1,070,535 |
| SMITH | 3,881,420 |
| LANGRISH-SMITH | 3,867,884 |
| GRAYSON | 3,731,626 |
| HELFGENI | 3,730,097 |
| PRIOR | 3,730,096 |
| CALDER | 3,726,216 |
| PRIOR | 3,382,802 |
| NODDIN | 3,311,056 |
| KELLY | 3,260,201 |
| HICKS | 3,125,024 |
| SMITH | 3,155,038 |
| GRANDY | 3,027,839 |
| ANDREW | 2,982,210 |
| ANDREW | 2,923,239 |
| DOLAN | 2,892,475 |
| JOHNSON | 2,380,312 |

The above-listed prior art suggests a variety of coverings for the mild detonating fuse, but is not consistently directed to actual confinement of the MDF and does not suggest the particular combination of coverings claimed by applicant.

Great Britain Pat. No. 847,743 uses loosely wound cotton yarn to provide spaces for flame/gas propagation and is not intended to confine anything.

West German Pat. No. 1,248,526 employs a single fiber and wire covering for the explosive core to obtain confinement. West German Pat. No. 1,124,413 uses fiberglass to confine "black powder" but does not confine detonating materials. West German Pat. No. 1,070,535 is related to the use of a dipicryl sulfone which is reinforced so as to be water proof; however, there is no suggestion of confinement.

Smith U.S. Pat. No. 3,881,421 is a smoke cord, using yarn 12, 14 to hold the product together. The yarn is not confining nor is the cord detonating. The smoke cord is deflagrating, that is, burning. Langrish uses textile wrappings for waterproofing detonating cord. The product is manufactured by Ensign-Bickford under the trademark PRIMACORD and is not intended to confine but rather explodes. Grayson is not concerned with confinement, but uses filaments to prevent stretching of the cord. Helfgeni uses a woven or spun overbraid to position or hold the items together, but does not claim to perform confinement. He expects the cord to rupture. Prior U.S. Pat. No. 3,730,096 employs a spun sheath as a strengthener for manufacturing and handling purposes, but has nothing to do with confinement. Calder is specifically constructed to ensure cross propagation and non-confinement. The multi-layer covering construction is designed for increased handling strength and moisture exclusion, but is of generally weak elements, for example, paper, wax, textile. Prior U.S. Pat. No. 3,382,802 uses metal and/or fiberglass coverings to replace the metal sheath normally used around small cord detonating materials to give the core the necessary confinement during detonation, thus providing a stable detonation velocity and adequate handling strength. There is no reference to confinement after detonation.

Noddin uses a tough flexible outer covering to absorb the detonation and expand to contain the gas and byproducts. Kelly is without intent to totally confine. He uses longitudinal spiral windings to provide core structure and handling strength and includes a foam outer covering to allow breathing and to exclude moisture, oil, etc. The core consists of black powder deflagrating material. It is submitted that a detonating material would disintegrate the Kelly cover. Hicks increases confinement of the explosive by an increase in the explosive area per unit length, thus reducing detonation velocity, it is submitted to the point of instability.

Smith U.S. Pat. No. 3,155,038 concerns PRIMACORD wherein a textile sheath is used to hold the explosive together without confinement, the intention being that it must not confine (column 1, line 16, "the ability to initiate itself by lap connection or a knot connection").

Grandy U.S. Pat. No. 3,027,839 concerns black powder which is not a detonation material. He uses internal space which collapses and increases free volume.

Andrew U.S. Pat. No. 2,982,210 uses small core load metal sheath covered explosive to reduce brisance and noise. Reinforcing is employed to guard against longitudinal stress and to protect the metal sheath against physical damage. It is submitted that in constructions of above one grain per foot explosive, the construction will not confine.

Andrew U.S. Pat. No. 2,923,239 uses fiberglass, cotton, linen, rayon, nylon or wire to withstand deflagration pressure. The configuration specifically excludes detonating material (column 3, line 36) "in general conventional deflagrating explosives will perform satisfactorily while detonating high explosives are not suitable".

Dolan U.S. Pat. No. 2,891,475 uses a flame to the extent that it will not ignite a flammable substance, namely a thermoplastic sheath impregnated with flame suppressing material.

Johnson U.S. Pat. No. 2,380,312 provides a cord, having higher handling and general service strength by wire braiding without reference to an improvement in confinement strength.

SUMMARY OF THE INVENTION

According to the present invention the mild detonating cord confinement includes a metallic sheath covered mild detonating fuse as an inner core, an extruded plastic jacket encircling the inner core, a plurality of plastic fiber overbraid coverings encircling the plastic jacket and a stainless steel overbraid outer covering encircling the plastic fiber overbraid. Modifications of invention include varying the type of plastic fiber overbraid as well as the number of coverings, and foaming the extruded plastic jacket.

BRIEF DESCRIPTION OF THE DRAWINGS

FIGS. 1A–1E is a cross-sectional view of various configurations of mild detonating cord confinement, according to the present invention.

DESCRIPTION OF THE PREFERRED EMBODIMENTS

Figure 2:
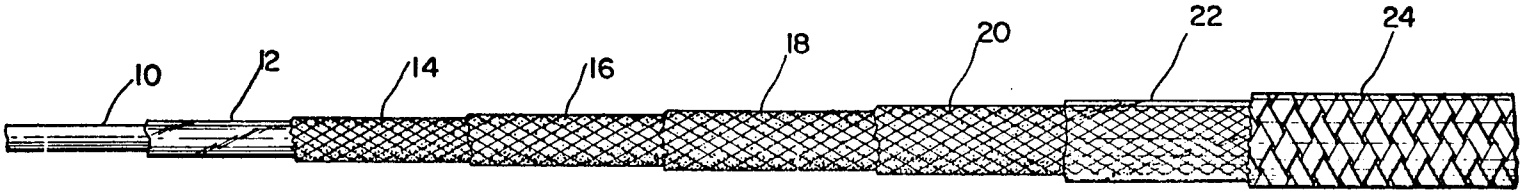
FIG. 2 is a fragmentary showing of a mild detonating cord confinement according to the present invention including 2.50 grain/foot silver-HNS II mild detonating fuse, an inner layer of extruded polyethylene, four layers of fiber overbraid, an outer layer of polyethylene and a stainless steel overbraid covering.

In the following description the fiber overbraid and foamed polyethylene materials are referred to as follows:

| | |
|---|---|
| Material "A"- | Owens Corning "S" Glass<br>P/N S2CG 150 1/0 1.0Z 636 Sizing<br>Package 8512 |
| Material "B"- | E. I. duPont de Nemours<br>P/N 195-134 Kevlar 49 Yarn |
| Material "C"- | Union Carbide<br>P/N DSD 4960 Extrusion Resin<br>Foamed Polyethylene |

FIRST TEST OBJECTIVE

To obtain a comparison between "E" Glass and Material "A" overbraid for MDC confinement.

Method

The configuration used in this study, shown pictorially in FIG. 1, Configuration "A", utilized 2.50 grain/-foot Lead-RDX explosive cord. The cord was initially covered with a polyethylene extrusion to a diameter of 0.100. One (1) each length of this covered MDC was braided with (a) "E" Glass and (b) Material "A" to the number of layers indicated below:

| TEST SAMPLE | MATERIAL | NUMBER OF LAYERS |
|---|---|---|
| 1 | "E" Glass | 6 |
| 2 | "E" Glass | 8 |
| 3 | "E" Glass | 10 |
| 4 | "E" Glass | 12 |
| 5 | Material "A" | 6 |
| 6 | Material "A" | 8 |
| 7 | Material "A" | 10 |

Both "E" Glass and Material "A" were braided with identical methods of remove any fabrication variables. Each sample was weighed before firing. The test samples were consecutively detonated in air with a blasting cap until confinement was achieved.

Results

Successful confinement was attained after application of ten (10) layers of Material "A" having a prefired diameter of 0.310–0.315 and a weight of 2.319 grams-/inch. Successful confinement was attained after application of twelve (12) layers of "E" Glass having a prefired diameter of 0.318–0.322 and a weight of 2.618 grams/inch.

Conclusion

Material "A" confinement is 15% lighter than "E" Glass. Material "A" confinement diameter is 3% smaller than "E" Glass.

SECOND TEST OBJECTIVE

To obtain a comparison between "E" Glass and Material "B" overbraid for MDC confinement.

Method

The configuration used in this study, shown pictorially in FIG. 1, Configuration "C", utilized 2.50 grains/-foot Lead-RDX explosive cord. The cord was initially covered with a polyethylene extrusion to a diameter of 0.100. One each length of this covered MDC was braided with Material "B" to the number of layers indicated below:

| TEST SAMPLE | MATERIAL | NUMBER OF LAYERS |
|---|---|---|
| 1 | "B" | 4 |
| 2 | "B" | 6 |
| 3 | "B" | 8 |
| 4 | "B" | 10 |

Each sample was weighed. The test samples were consecutively detonated in air with a blasting cap until confinement was achieved.

Results

Successful confinement was attained after application of 8 layers of Material "B" having a prefired diameter of 0.284/0.288 and a weight of 1.483 grams/inch.

Conclusion

Material "B" confinement is 43% lighter than "E" Glass. Material "B" confinement diameter is 11% smaller than "E" Glass. The quality of the Material "B" after 8 layer confinement indicates that confinement can be achieved with 7 layers.

THIRD TEST OBJECTIVE

To further prove the confining characteristics of Material "B" as a comparison with "E" Glass by confining high energy cord.

Method

The configuration used in this study, shown pictorially in FIG. 1, Configuration "B", utilized 10–12 grain/-foot aluminum RDX mild detonating cord. The cord was initially covered with a polyethylene extrusion to a diameter of 0.175 inches.

One (1) each length of this covered MDC was braided with (a) "E" Glas and (b) Material "B" to the number of layers indicated below:

| TEST SAMPLE | MATERIAL | NUMBER OF LAYERS |
|---|---|---|
| 1 | "B" | 8 |
| 2 | "B" | 10 |
| 3 | "B" | 12 |
| 4 | "E" Glass | 16 |
| 5 | "E" Glass | 18 |
| 6 | "E" Glass | 20 |

The test samples were consecutively detonated in air with a blasting cap until confinement or sufficient evidence to support objective was achieved.

Results

Successful confinement was attained after application of 12 layers of Material "B" having a prefired diameter of 0.485 inches. Complete disintegration of the "E" Glass occured in the 16 layer sample and testing was terminated since the objective was satisfied.

FOURTH TEST OBJECTIVE

To further reduce diameter and/or weight of MDC confinement utilizing a combination of materials.

Method

The configuration used in this study, shown pictorially in FIG. 1, Configuration "B", utilized 2.50 grains/-foot silver-HNS explosive cord. The cord was initially covered with a polyethylene jacket extruded to the smallest diameter practicable.

Four (4) test samples were braided with a combination of materials as shown in the matrix below:

| MATERIAL | TEST SAMPLE 1 | 2 | 3 | 4 |
|---|---|---|---|---|
| 2 Layers of Material "B" | ✔ | | | |
| 3 Layers of Material "B" | | ✔ | | |
| 4 Layers of Material "B" | | | ✔ | ✔ |
| Outer Layer of Polyethylene | ✔ | ✔ | ✔ | |
| 1 Layer Stainless Steel Braid | ✔ | ✔ | ✔ | ✔ |

Each sample was weighed. The test samples were consecutively detonated in air with a blasting cap.

Results

Successful confinement was attained by all test samples.

Test Sample 1 confined having a prefired diameter of 0.235 inches and weighing 1.60 grams/inch. Test Sample 2 confined having a prefired diameter of 0.230 and weighing 1.45 grams/inch. Test Sample 3 confined having a prefired diameter of 0.273 inches and weighing 1.75 grams/inch. Test Sample 4 confined having a prefired diameter of 0.225 inches and weighing 1.40 grams-/inch.

Conclusion

The combination of materials represented by Sample 4 gave the best overall results and exhibited a diameter 29% smaller than "E" Glass and weighed 46% less than "E" Glass.

The excellent condition of the line materials after detonation is shown in the upper portion of the photograph FIG. 2 attached. The lower photograph is Test Sample 1 and also shows the excellent condition of the post-fired material.

FIFTH TEST OBJECTIVE

To study the effect of substituting the polyethylene covering on the MDC for a foam material to establish some free volume between the detonating cord and its confining layers.

Method

The configuration used in this study, shown pictorially in FIG. 1, Configuration "D", utilized 2.50 grain/-foot Lead/RDX explosive cord. The cord was initially covered with one (1) layer of Material "B" and an outer layer of extruded material "C" to a diameter of 0.187 inches. Three (3) test specimens were fabricated, one with four (4) additional overbraids of Material "B", one (1) with five (5) and another with six (6). Each sample was weighed before firing. The test specimens were consecutively detonated in air with a blasting cap until confinement was achieved.

Results

Successful confinement was attained after application of six (6) layers of Material "B" having a prefired diameter of 0.315/0.320 and weighing 1.56 grams/inch.

Conclusion

This particular material combination has not improved on the 0.225 diameter and 1.40 grams/inch exhibited by Test Specimen 4 in the Fourth Test Objective. However it is greatly superior to existing "E" Glass confinement weight.

SIXTH TEST OBJECTIVE

To study the effect of adding a layer of stainless steel overbraid to the test configuration established in the Sixth Test Objective.

Method

The configuration used in this study, shown pictorially in FIG. 1, Configuration "D" with an added outer layer of stainless steel, utilized 2.50 grains/foot silver HNS explosive cord. The cord was initially covered with one (1) layer of Material "B" and an outer layer of extruded Material "C" to a diameter of 0.187 inches. Three (3) test specimens were fabricated, one (1) with one (1) addition overbraid of Material "B", one (1) with two (2) and another with three (3). Each of the three (3) test specimens was covered with one (1) overbraid of stainless steel.

Each sample was weighed before firing. The test samples were consecutively detonated in air with a blasting cap.

Results

Successful confinement was attained by all samples the smallest being 0.230 diameter with a weight of 1.26 grams/inch.

Conclusion

This result represents a further 10% reduction in weight from the previous lightest (Test Sample 4 in the Fourth Test Objective) for only a small increase in diameter.

Figure 5:
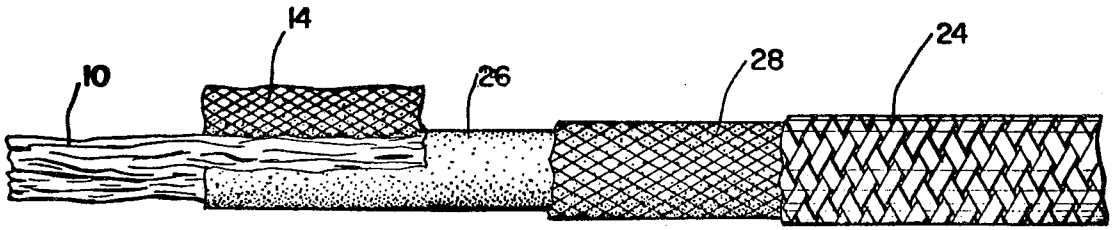
FIG. 5 is a further modification of invention showing a silver sheath HNS as the mild detonating fuse inner core, a first layer Kevlar fiber overbraid, an extruded polyethylene foam covering said first layer, a second layer Kevlar fiber overbraid and a stainless steel overbraid covering.

The good condition of the line after detonation especially the completeness of the inner Material "C", is shown in the photograph FIG. 5 attached. With further studies on the extrusion thickness of Material "C" a further decrease in diameter is expected.

In FIG. 2 there is illustrated in fragment a mild detonating cord confinement including 2.50 grains/foot silver HNS II as the inner core 10, a single inner layer polyethylene 12, four layers of Kevlar 49 fiber overbraid 14, 16, 18 and 20, a second outer layer of polyethylene 22 and a stainless steel overbraid cover 24.

Figure 3:
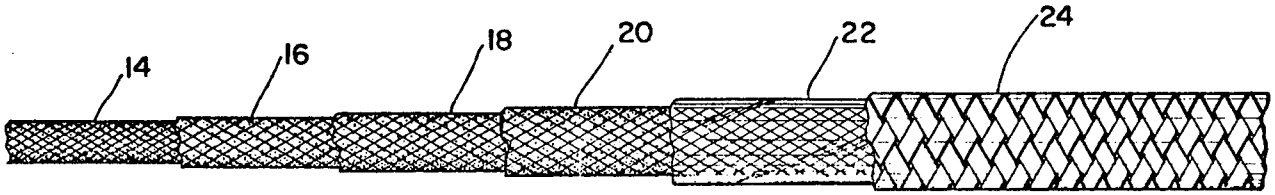
FIG. 3 is a mild detonating fuse confinement including 2.50 grain/foot silver HNS II inner core, an extruded polyethylene jacket, four layers of Kevlar fiber overbraid and an outer stainless steel overbraid.

In FIG. 3 there is further illustration of the FIG. 2 confinement, having mild detonating fuse inner core 2.50 grain/foot silver HNS II, an inner layer of polyethylene (not illustrated), four layers of Kevlar fiber overbraid 14, 16, 18 and 20, an outer polyethylene jacket 22 and a stainless steel overbraid covering 24.

Figure 4:
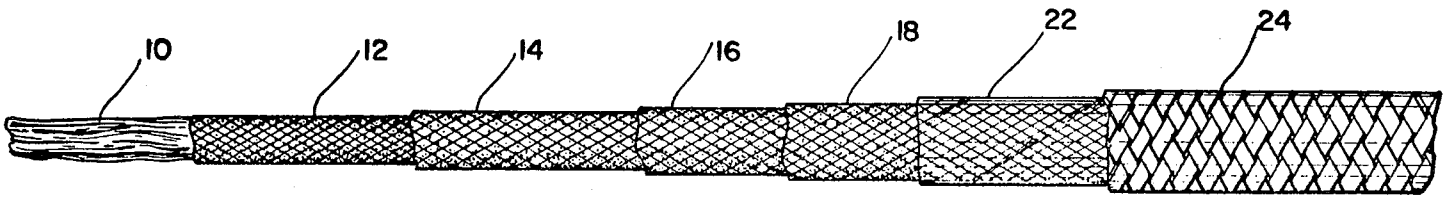
FIG. 4 is a further modification showing a silver covered HNS sheath as the mild detonating fuse core, an inner polyethylene jacket, three layers of Kevlar fiber overbraid, an outer polyethylene jacket and a stainless steel overbraid covering.

In FIG. 4 there is illustrated the mild detonating fuse confinement including a 2.50 grain/foot silver HNS II inner core 10, an inner polyethylene jacket 12, three layers of Kevlar fiber overbraid 14, 16, 18, an outer polyethylene jacket 22 and a stainless steel overbraid covering 24.

In FIG. 5 there is illustrated the mild detonating fuse confinement including a 2.50 grain/foot silver HNS II MDF core 10, an inner layer of Kevlar fiber overbraid 14, a covering layer of polyethylene foam 26, an outer layer Kevlar fiber 28 and a stainless steel overbraid covering 24.

Manifestly, various types of coverings may be substituted without departing from the spirit of invention.

We claim:

1. A mild detonating cord confinement comprising:

(A) An approximately 2.50 grain/foot metallic covered inner core of detonating high explosive material and means for confining the explosive effects without rupture when the explosive is detonating, further comprising:

(i) a layer of plastic fiber overbraid encircling said inner core;

(ii) a layer of foam encircling said overbraid, and (iii) at least one layer of plastic fiber overbraid as an outer covering;

said mild detonating cord outer diameter being no larger than about 0.320 inches.

2. A mild detonating cord confinement as in claim 1, wherein the diameter of said layer of foam encircling said overbraid is approximately 0.187 inches, and said foam is polyethylene foam.

3. A mild detonating cord confinement as in claim 2, including six layers of plastic fiber overbraid as said outer covering.

4. A mild detonating cord confinement as in claim 3, said mild detonating cord confinement weighing approximately 1.56 grams per inch.

5. A mild detonating cord confinement comprising:

(A) a mild detonating fuse having an approximately 2.50 grain/foot metallic covered inner core of detonating high explosive material and means for confining the explosive effects without rupture when the explosive is detonated, further comprising:

(i) a first layer of plastic fiber overbraid encircling said core;

(ii) a polyethylene foam layer covering said overbraid;

(iii) a second outer layer of plastic fiber overbraid covering said foam; and (iv) an outer layer of stainless steel overbraid; said cord outer diameter being no larger than about 0.230 inches.

6. A mild detonating cord confinement as in claim 5, the diameter of said foam layer covering said first overbraid layer being approximately 0.187 inches.

7. A mild detonating cord confinement as in claim 6, wherein said second layer comprises at least two layers of plastic fiber overbraid covering said foam.

8. A mild detonating cord confinement as in claim 6, wherein said second layer comprises at least three layers of plastic fiber overbraid covering said foam.

9. A mild detonating cord confinement as in claim 5, said mild detonating cord confinement weighing approximately 1.26 grams per inch.

* * * * *